United States Patent [19]

Munoz

[11] 4,165,799

[45] Aug. 28, 1979

[54] DISMOUNTABLE TOWER FOR INTERIOR MAINTENANCE OF SPHERICAL TANKS

[76] Inventor: German R. Muñoz, Prolongación Sur 128 No. 134, México City 18, Mexico

[21] Appl. No.: 922,887

[22] Filed: Jul. 7, 1978

[51] Int. Cl.[2] ..... E04G 3/10; E04H 7/00

[52] U.S. Cl. ..... 182/128; 182/2

[58] Field of Search ..... 182/128, 2, 141, 148; 212/57, 58 R, 61, 64; 52/40

[56] References Cited

U.S. PATENT DOCUMENTS

| | | | |
|---|---|---|---|
| 1,864,934 | 6/1932 | Reeves | 182/2 |
| 3,306,396 | 2/1967 | Goss | 212/57 |
| 3,556,252 | 1/1971 | Atkins | 182/128 |
| 4,068,419 | 1/1978 | Decoppet | 182/128 |

FOREIGN PATENT DOCUMENTS

| | | | |
|---|---|---|---|
| 596557 | 8/1925 | France | 182/128 |
| 119672 | 11/1958 | U.S.S.R. | 182/2 |
| 138728 | 11/1960 | U.S.S.R. | 182/2 |

*Primary Examiner*—Reinaldo P. Machado
*Attorney, Agent, or Firm*—Cameron, Kerkam, Sutton, Stowell & Stowell

[57] ABSTRACT

The present invention refers in general to dismountable structures, and more particularly involves a dismountable structure for inside maintenance in spherical tanks, providing two rotatable towers, one atop the other, with anti-friction bearings for rotation up to 360°, supported at top and bottom by rotary elements, and having at mid-section hinged arms carrying baskets and auxiliary arms and a rotary device for movement upward and downward for vertical work for the basket-supporting arms; it comprises in addition operating baskets having capacity to carry operators and inspection and maintenance equipment with illumination; the structure also affords safety winches with rack levers for raising and crank for descending, as well as auxiliary cable arms to provide a suitable angle of loading.

6 Claims, 5 Drawing Figures

DISMOUNTABLE TOWER FOR INTERIOR MAINTENANCE OF SPHERICAL TANKS

BACKGROUND OF THE INVENTION

It is well known there is a difficult problem involved in providing interior maintenance to spherical tanks, because of the inaccessibility of points inside because of the volume and great size which they may have, when it is necessary to carry out maintenance inspection thereof. The latter are of vital importance, since liquids or gases are stored therein under pressure, or solvents or liquids the safe keeping of which is imperative.

Structures have been designed to carry out inspection while assembly is under way, or for the construction and inside assembly of pieces within the said spherical tanks, such as the case of U.S. Pat. No. 4,068,419, which shows a central tower supported on a fixed base and shows structural scaffolding supported by cables which run from the said central tower to the remote points which it is desired to inspect or provide maintenance to; the said structure is fixed. Which leads to the necessity of using a large number of scaffolds, communicating at their ends by means of catwalks. All of this requires a large quantity of structural elements, as well as numerous personnel for their installation, and a large amount of manhours for their assembly; and these factors make it relatively impractical and of high cost because of the materials and working time employed.

The advantages of the present invention over the known mechanisms resides primarily in the innovation of a gyratory element with vertical elevation and descent, by means of which any inside point can be reached as needed without requiring a large number of structural elements inside the spherical containers. Furthermore in the present invention the articulations are controlled by winches and cables which are easily handled and very efficacious for reaching any point on the inside of the structure as may be desired, by rotating the central towers and causing the basket-supporting arms to rise or descend. The latter in turn enjoy independent movement since each one is mounted on a respective one of the central towers. The working baskets are secured to the supporting arms, and thus there is no need to perform extra work upon the walls of the container for securing or supporting work units or baskets. The working units are constructed within the baskets with sufficient space for operators therein as well.

SUMMARY OF THE INVENTION

One of the objects of the present invention is to provide a structure which is easily assembled and disassembled on the inside of a spherical tank for inspection or maintenance of its inside points in any location by means of including rotary pieces and hinges to provide rising and descending movement by means of a winch and a crank for each.

Another object of the present invention is to provide for mounting the central towers one upon the other so that they will have independent rotation, thus permitting the supporting arms to move independently to any position.

A further object of the present invention is to provide an auxiliary cable arm for the purpose of giving a suitable loading angle.

Still another object of the present invention is that of providing baskets secured to the support arms, in which the necessary equipment for inspection or maintenance and also the operators can be carried, the baskets being in addition provided with a system of illumination and with electrical contacts for connecting necessary auxiliary equipment.

DETAILED DESCRIPTION OF THE INVENTION

Figure 1:
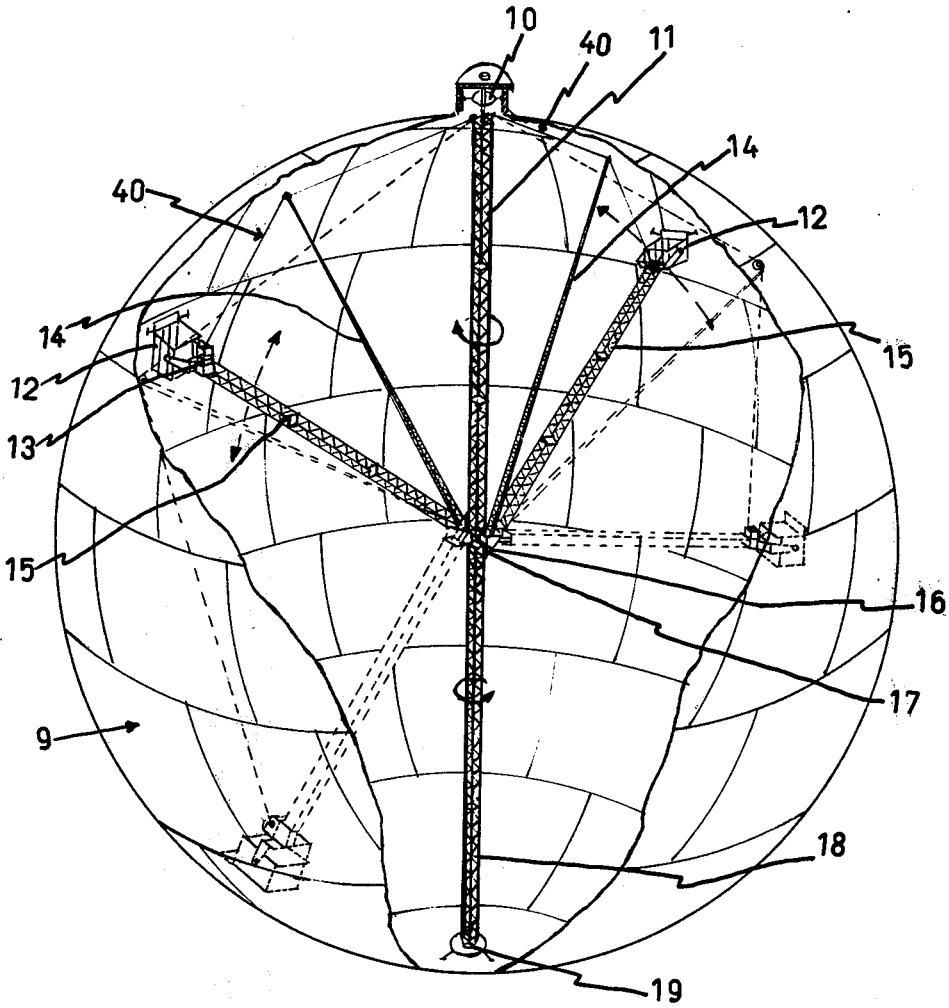
FIG. 1 is an isometric view in lateral elevation with a portion cut away, showing the dismountable tower for providing inside maintenance to spherical tanks, the subject of the present invention.

As appears in FIG. 1, the present invention presents a tank 9 in the interior of which the rotary structure of the present invention is assembled; this consists of an upper element 10 having anti-friction bearings, in which the upper tower 11 turns. Lower tower 18 at its upper end carries pivots or hinges means 16 for its respective support arm 15, and at its lower end is connected to lower rotary element 19. Support arms 15 are mounted at one end in rotary support 17 permitting them gyratory travel in a vertical sense for raising and lowering, and at their respective outer ends are connected to operating baskets 12 which carry each a winch 13 with cable 40 which is supported by an auxiliary cable arm 14 to provide the suitable angle for the load.

Figure 2:
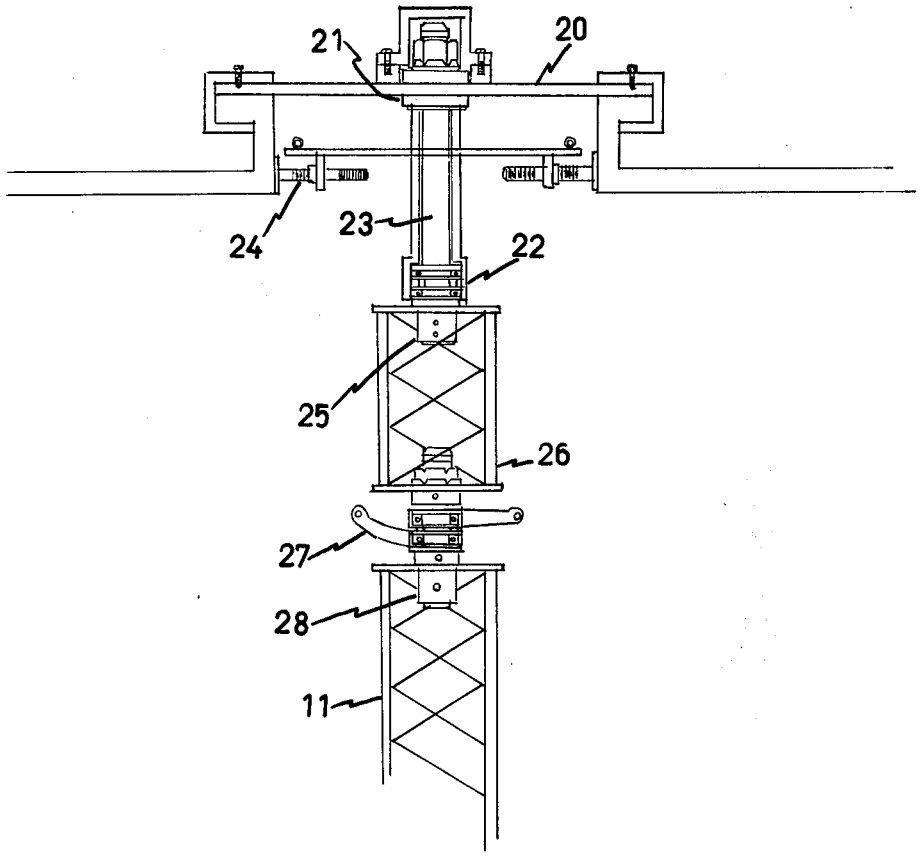
FIG. 2 is an enlarged view in side elevation of the rotary element of the upper tower.

As is shown in FIG. 2, upper support element 20 for carrying the man-carrying device in the tank consists of a bearing shell 21 carrying tapered bearings at one of its ends, and at the other of its ends double row roller bearings 22 joined by support shaft 23, and rotary element 10 is secured by means of threaded feet 24. At the lower end of double roller bearing 22 there is a support ring 25 on which is mounted a segment of a tower 26 which at its lower end is joined by bolt and nut to bearing-mounted arms 27; the latter have orifices in their outer ends to which cables 40 are connected, and at the lower end of the bolt which carries bearing-mounted arms 27 there is support ring 28 on which the upper end of upper vertical support tower 11 is mounted.

Figure 3:
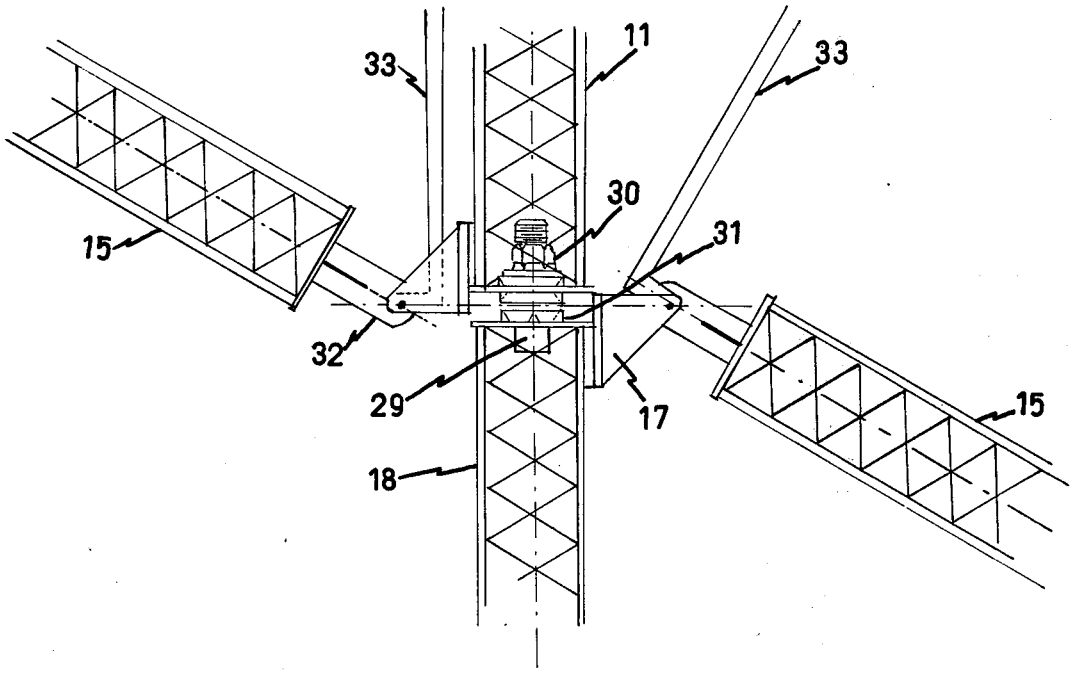
FIG. 3 is an enlarged view in side elevation of the rotational devices of the upper and the lower towers respectively, showing the arm hinging provided on the tower and that of the auxiliary arms.

As shown in FIG. 3, the rotary provision for upper tower 11 and lower tower 18 comprises a steel shaft 29 and adjusting nut 30 joining upper tower 11 and lower tower 18 by means of bearing assembly 31 which affords independent rotation for each tower. At the lower end of upper tower 11 and the upper end of lower tower 18 are secured respective supports 17 for vertical gyratory movement of respective arms 15 mounted therein by pivots or hinge elements 32. Supports 17 also support auxiliary arms 33 pivotally for controlling the working angle of cable 40.

Figure 4:
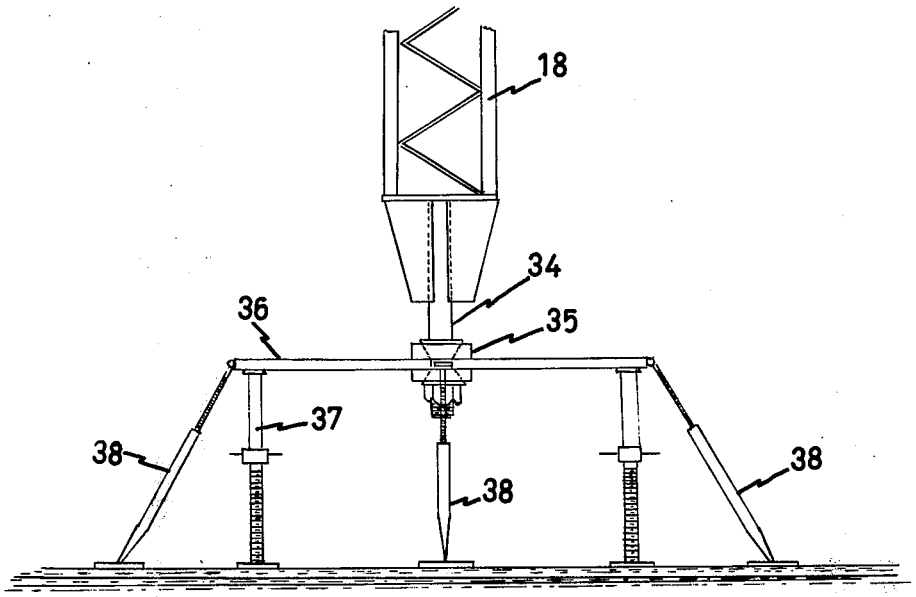
FIG. 4 is an enlarged view in side elevation of the lower rotary element mounted in anti-friction bearings for rotation of the lower tower and support.

FIG. 4 shows the lower rotary element 19 in anti-friction bearings and exhibits the lower end of tower 18 which carries at its center a steel shaft 34 which in turn is monted in a tapered roller bearing assembly 35 to be secured to sectional support plate 36 beneath which fine adjustment threaded feet or jacks 37 are mounted, and at its ends angular threaded adjusting elements 38 to resist lateral slipping.

Figure 5:
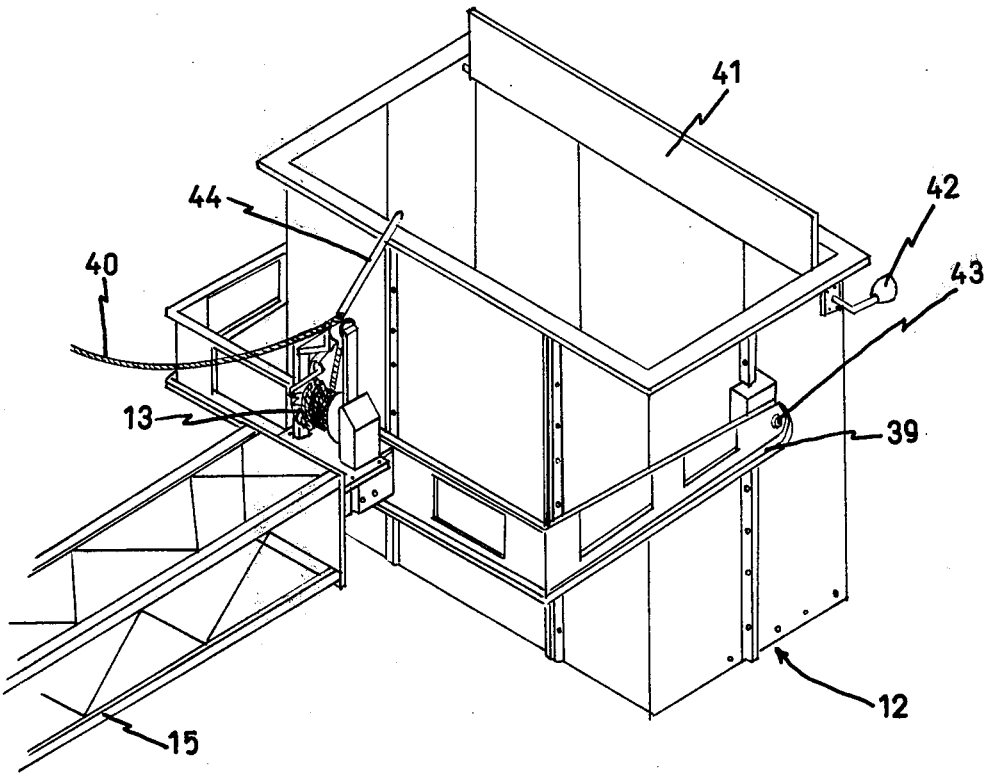
FIG. 5 is an isometric view of the working basket.

FIG. 5 is a view of working basket 12 connected to the outer end of support arm 15, showing winch 13 with cable 40, which supports and determines the angle of working basket 12 within the tank; below the base of winch 13, the outer end of support arm 15 terminates in support member 39 providing pivotal support for working basket 12, pivotal pins 43 providing the rocking support where they engage basket 12. Basket 12 also carries protecting plate 41 and system of illumination 42. Also shown is descent control lever 44 for winch 13.

What is claimed is:

1. A demountable tower for interior maintenance of spherical tanks of the kind comprising structures which can be disassembled, characterized in that it consists of central towers which have respectively independent rotary travel and which at their respective ends are connected to means permitting 360° of rotation, and which at the intermediate point where upper and lower towers are interconnected carry respective support means for support arms allowing them rising and descending travel in a vertical plane by means of pivotal means; at the respective outer ends of said pivoted support arms working baskets are mounted, being moved and supported by means of winch and cable, said cable passing over a respective auxiliary arm, said working baskets being of sufficient size to carry necessary equipment and operators; said auxiliary arms are pivoted at their inner ends in said pivotal means and at their outer ends carry pulley means over which said cable passes thereby maintaining appropriate loading angle for said cable.

2. A demountable tower assembly for interior maintenance of spherical tanks as set forth in claim 1, characterized in that the mechanisms for independent vertical and independent horizontal travel permit access to every internal point of the said tank.

3. A demountable tower assembly for interior maintenance of spherical tanks as set forth in claim 1, characterized in that the rotary support comprises a tapered roller bearing assembly connected to a double row roller bearing, threaded support feet for the rotary support, a supporting shaft having a ring junction, a tower segment mounted on said ring junction, and arms mounted in anti-friction bearings for rotational support of cables, having a ring support on which vertical tower upper end is mounted.

4. A demountable tower assembly for interior maintenance of spherical tanks as set forth in claim 1, characterized in that the mechanism for rotation intermediate the said upper and lower towers comprises a steel shaft having an adjusting and securing nut, a tapered roller bearing assembly mounted on said shaft, and to each of the proximate ends of respective upper and lower towers a respective arm support is attached having hinge means permitting vertical travel of respective support arms carrying said working baskets at outer ends of respective support arms, and also having pivotally mounted in said arm support the inner ends of auxiliarly arms which regulate the working angle of support cables.

5. A demountable tower assembly for interior maintenance of spherical tanks as set forth in claim 1, characterized in that the lower rotary support mechanism is provided with anti-friction bearings to allow rotation of lower tower and support, and further comprises a steel shaft embedded in lower end of lower vertical tower, and in that the shaft at its other end is connected to a tapered roller bearing assembly which in turn is supported on a sectional support plate held by a nut threaded onto the steel shaft, the support plate being carried by threaded foot elements for precise adjustment and preferably with angular supports for lateral anti-slip support.

6. A demountable tower assembly for interior maintenance of spherical tanks as set forth in claim 1, characterized in that the outer ends of said support arms mount respective working baskets which can be positioned and are pivotably supported upon hinge means mounted in support member partially surrounding said basket, having safety winch with lever actuated for raising or lowering unit and separate lever for raising, basket further having a safety protecting plate as well as lighting installation and power connections for operating auxiliary equipment.

* * * * *